United States Patent [19]

Margolin

[11] Patent Number: 4,517,421

[45] Date of Patent: May 14, 1985

[54] RESILIENT DEFORMABLE KEYBOARD

[76] Inventor: George D. Margolin, 1815 Sherington Pl., Apt. V-203, Newport Beach, Calif. 92663

[21] Appl. No.: 468,035

[22] Filed: Feb. 18, 1983

Related U.S. Application Data

[63] Continuation of Ser. No. 116,291, Jan. 28, 1980, abandoned.

[51] Int. Cl.[3] ..... H01H 9/00; H01H 13/70

[52] U.S. Cl. ..... 200/1 R; 200/5 A; 200/DIG. 1; 235/145 R

[58] Field of Search ..... 235/145 R, 145 A, 92 V; 200/5 A, 5 R, DIG. 1, 1 R; 400/479

[56] References Cited

U.S. PATENT DOCUMENTS

| | | | |
|---|---|---|---|
| 3,584,162 | 6/1970 | Krakinowski | 400/479 X |
| 3,860,771 | 1/1975 | Lynn et al. | 400/479 X |
| 3,940,758 | 2/1976 | Margolen | 200/5 A |
| 4,032,729 | 6/1977 | Koistinen | 400/479 X |
| 4,090,045 | 5/1978 | Marsh | 200/5 A |
| 4,227,071 | 10/1980 | Tomyn | 235/92 V X |

OTHER PUBLICATIONS

IBM Technical Disclosure Bulletin, "Keyboard Switch With Stroke and Feedback Enhancement Using Vertically Conducting Elastomer in a Laterally Conducting Mode", vol. 20, No. 5, Oct. 1977.

*Primary Examiner*—Benjamin R. Fuller

*Attorney, Agent, or Firm*—Bromberg, Sunstein & McGregor

[57] ABSTRACT

An array of fluid filled cells bearing symbols on their faces transmit applied pressure or displacement to a remote end of the cell which have a mating array of electrical switches normally maintained in an open position. Pressure or displacement of the upper surface of the cell is transmitted to the lower surface to operate (close) the switch. Upon removal of the applied pressure, the cell returns to its initial position. A second embodiment of the invention shows an entirely modular key formed from a rubber-like material or from a self-skin foam material such as a polyurethane. The modular key has the keyface, body and switch elements formed integrally so that the keys can be added to a premated matrix. Still another embodiment of the present invention shows a totally sealed electronic terminal or device which is specially adapted to accept the modular keys.

16 Claims, 7 Drawing Figures

RESILIENT DEFORMABLE KEYBOARD

This application is a continuation, of application Ser. No. 116,291, filed Jan. 28, 1980 now abandoned.

FIELD OF THE INVENTION

This invention relates to electronic keyboards particularly of the type used in hand held calculators, translators and other electronic equipment.

BACKGROUND OF THE INVENTION

Keyboard inputs for electronic equipment are familiar in the art. Earlier in the development of the art, electronic equipment was relatively large. When such equipment is large, there is sufficient space to allow mechanical movement of the keys such as exists in a typical typewriter or desk calculator.

With hand held equipment, space is at such a premium that little or no space is available for key travel. As a result a number of flat keyboards have been invented. Most of these flat keyboards fail to provide for a satisfactory response or "feel" for most users. From a human factors viewpoint, it is highly desireable if the keys when actuated provide a feedback to the user. The absence of such feedback seems to require the user to spend more time examining the device to make certain that the keys depressed have registered with the device.

BRIEF DESCRIPTION OF THE INVENTION

The present invention is in part based on the observation that a small cell of air contained within a thin wall or plastic material gives a satisfactory feedback response to an operator when it is pressed. Accordingly, mounting keyfaces on an array of such air filled plastic cells permits a functionally attractive keyboard to be implemented. A suitable support has apertures which provide channels for guiding the cells so that pressure on the keyface is transmitted to the key switch placed under the cell.

The sensed resilience to touch is a property of the viscosity and the resilience of the fluid contained within the cell and the resilience of the cell's shell. Consequently, by tailoring the materials within the cell and the cell outer covering, the "touch" and sensed "travel" can be determined. In this manner, the "feel" of a typewriter key can be created from a structure which has the speed, simplicity and cost of a flat keyboard.

The invention is directed at apparatus which includes a keyboard having a plurality of keyfaces and switches having an intermediate layer of an array of cells filled with a fluid. The cells rest on a member having a mating array of channels. The channels serve to direct the force from a keyface to a keyswitch.

DESCRIPTION OF THE INVENTION

Figure 1:
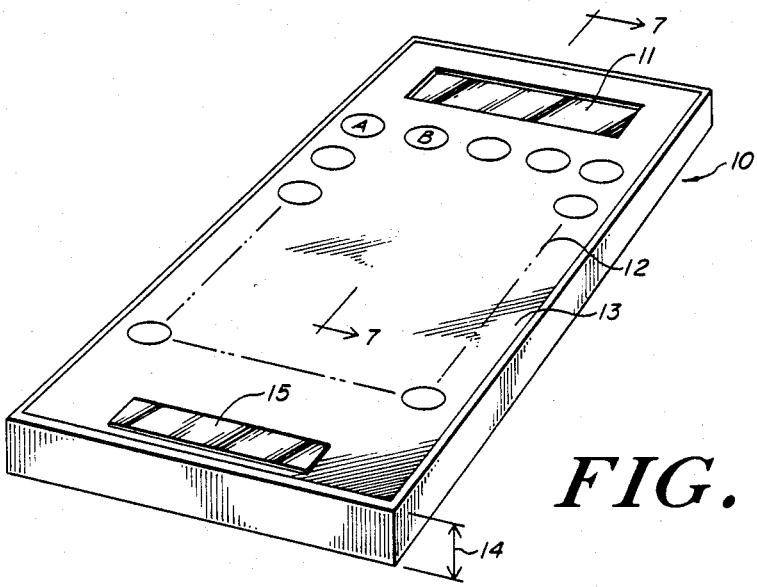
FIG. 1 shows a perspective view of a hand held calculator in accordance with this invention.

FIG. 1 shows a hand held calculator 10 having a a display 11 and an array of keyfaces 12. The device 10 has a thickness 14 determined to a large extent by the thickness of the keyboard assembly.

Figure 2:
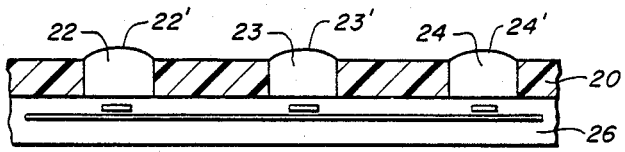
FIG. 2 shows a sectional view of a portion of the keyboard shown in FIGS. 1; and, FIGS. 3 and 4 show exploded views, partially in section, of other embodiments of the present invention.

A keyboard assembly typically has a first planar member 20 having keys, 22,23 and 24. The faces of the keys 22', 23' and 24' bear some symbol for forming a desired keyboard 13. FIG. 2 shows a second member 26 which is a switch array well known in the art. Commonly, such switch arrays contain a plurality of crossed conductors whose crossover points are slightly separated until pressure on one of the conductors results in the closing of the space between the conductors and the generation of an electronic signal for actuating some portion of the electronic circuitry, not shown, contained in the device 10.

Figure 3:
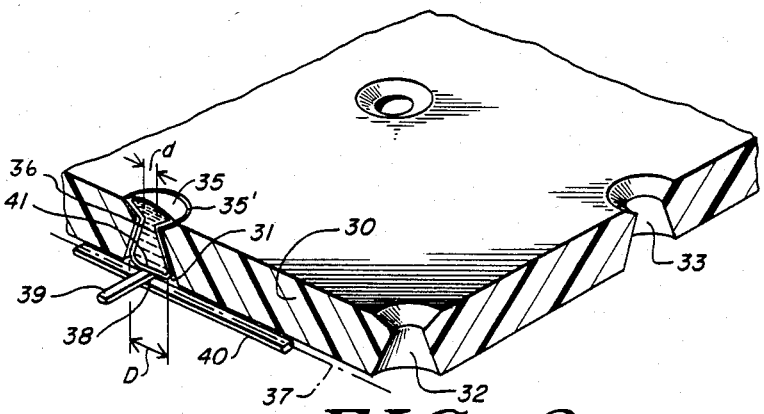

In accordance with the present invention, pressure at a keyface is transmitted to the associated switch, thereby closing the switch, by a cell which is at least partially filled by a fluid, such as air or a gel. FIG. 3 shows one embodiment of the present invention with a first keyboard member (or first planar member) 30 having a plurality of channels 31,32 and 33 placed to mate with the layout of the keyfaces shown in FIG. 1. A cell 35 occupies the channel 31. The cell is filled with a fluid 36 such as air or partially filled with another fluid and air for example.

A second planar member represented by broken line 37 is fixed in a mated position with respect to the first planar member 30. The second member has a plurality of conductors 39 and 40 disposed at some angle to each other which define a plurality of of cross points shown at 38. Pressure on the top surface 35' of cell 35 is transmitted to the bottom surface 41 of the cell 35 and normally causes its displacement thereby urging connection of conductors 39 and 40 and effectively operating an electrical switch.

Figure 4:
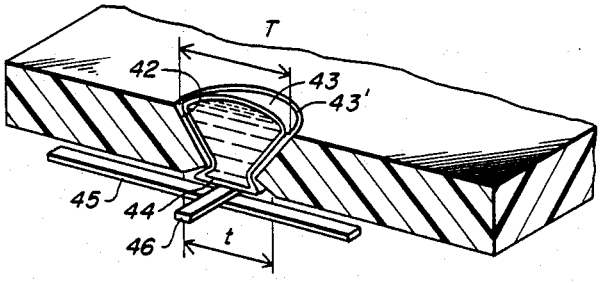

FIG. 4 shows a second embodiment of the present invention having a channel 42 which is smaller at the switch end than at the keyface end, i.e. distance T is greater than t. In contrast, FIG. 3 shows a channel 31 in which distance d is less than D. The cells 35 and 43 are shaped with a tapered section or modified "hourglass" shape to interlock with the respective planar members 30 and 42. Conductors 45 and 46 are shown in position relative to cell 43 to be interconnected by pressure on or displacement of cell 43 top surface 43'. Conductors 45 may be formed on the outer face 44 of the cell 43.

The channels 31 and 42 interact with the cell to transmit pressure or displacement of the cell's upper surface 35' and 43' to the cell's lower surface 41 and 44. The channels act to contain all lateral movement of the cell. The type, volume, viscosity, pressure and the like of the fluid contained within the cell will determine the amount of displacement of the cell's lower surface as well as the speed of displacement and the rate and extent of recovery at the cell to its predisplaced position. The factors are also partially controlled by the cell material and its thickness, geometry and rigidity.

The cell geometries shown in FIGS. 3 and 4 illustrate that the keyface area may be much larger than the switch area. Thus the size of the switch area is independent of the size of the keyface.

In a typical construction, the keyfaces are arranged on $\frac{3}{4}''$ to $\frac{1}{2}''$ centers. The switch end of the cell may have an area of about 0.002 in. The cell has a thickness of about 0.1 in. with a range from 0.05 to 0.50 inches. The channels may have T and t in ranges of 0.5" to 0.05" and 0.005" to 0.50", respectively. The travel of the upper surface of the cell 35' is about ¼", while the lower surface travels about 0.001" to about 0.005".

Typically a cell will be formed from a deformable plastic material such as methacrylate. Another embodiment of the invention would use a cell array without requiring a first planar member with channels. Glycerin will provide an acceptable fluid for use within a cell.

While it should be clear that the present invention could be readily adapted for use in present keyboard devices using commonly used switch arrays, it should also be clear that the cell structure itself could have keyfaces formed on one side and a conductive surface on the other side. In whatever mode the present invention is utilized, it is clearly an invention which offers important functional advantages at very low cost.

Because the present invention gives the user "feed back" through the fingertips it can be used for electronic devices of all kinds including typewriters, calculators, computer keyboards, etc. Importantly, the present invention offers significant advantages to the visually impaired or handicapped.

While the cell 35 has been described as a plastic member, it is within the scope of the present invention if it is a geometrically deformable material which resists deformation and which has sufficient elastic properties to return to its original undeformed postion. The cell should be an impermeable material. It may advantageously have variable elasticity. The cells should preferably have rigid top surfaces and elastic sides.

The cells may be filled with air, oil, water, other gases, mixtures of liquids and gases, putty and gelatin like materials, e.g. silicone potting material. Other variations within the scope and spirit of the present invention will be apparent to those skilled in the art. Such variations are intended to be within the scope of the appended claims.

Figure 5:
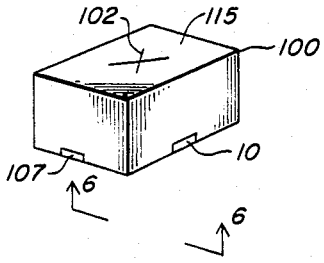
FIGS. 5 and 6 show a still further embodiment of the present invention.
Figure 6:
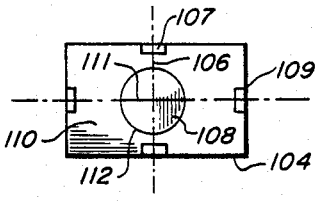
Figure 7:
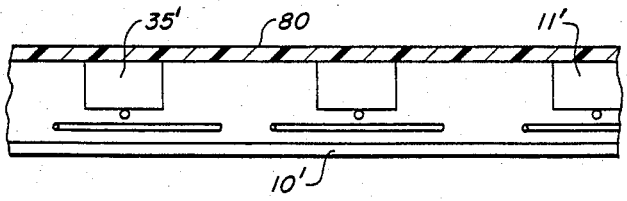
FIG. 7 shows a sectional view of the device shown in FIG. 1.

FIGS. 5 and 6 show respectively a perspective view and a bottom view of another embodiment of the present invention in which a self-contained key 100 has a symbol "X" 102 thereon and a bottom surface 104, "X" is intended to represent any desired symbol. The key 100 can be formed of a solid elastic material such as rubber, silicone rubber and the like or of a "self-skin" material such as a polyurethane or other plastic material which has an exterior skin and an interior which remains in liquid or semi-liquid form. This type of self-skin material, or solid elastic material can have a variable rate of elasticity and can be formed of variable density materials.

The key 100 has a bottom surface 104 has a conductor 106 formed thereon with terminal lands 107, 109. Separating the bottom 104 from an interior layer 108 is a sheet of flexible material 110 having an aperture 112. Surface 108 has a conductor 111 formed thereon which can make physical and electrical contact with conductor 106 when the key upper face 115 is pressed. Another embodiment of the key 100 would have only the conductor 111 as the bottom surface of the key. In that form, the device into which the key were inserted would have to have its own conductor to complete the circuit with conductor 111.

No matter whether a rubber material is used or a self-skin foam is used, the key 100 thus formed in accordance with FIGS. 5 and 6 is a wholly self-contained modular key. A key so formed will be totally sealed from a hostile environment be it spilled coffee, oil, chemical vapors, high or low temperatures. The key properly compensated for pressure changes could be used either in space or under water.

In a further development of the totally sealed device, FIG. 2 shows a calculator 10" housing cells 35' and display 11' with a shrink wrap film 80 fitted thereto which seals the device against external fluids, vapors and other disturbing factors. As shown in FIG. 1, if the device 10 had a solar cell 15 or other source of internal power, it could be totally self-contained and independent of its enviroment.

There is a natural and inventive mating of the various embodiments of the present invention with the device, also invented by the present inventor, which is shown in U.S. Pat. No. 3,940,758. That patent shows a modular and expandable keyboard. When the novel keys of the present invention are mated into a matrix/similar to that shown in FIG. 2, as planar member 20, and then combined with an expandable keyboard, the result is a keyboard which is expandable both in groups of keys or in single keys. If the present invention were used in an electronic terminal, such as a computer, teletype, numerically controlled machine terminal or the like, it would have exceptionally flexible expansion capabilities. Such a device could also be totally sealed against hostile external influences.

What is claimed is:

1. An improved keyboard of the type having an array of keyfaces and a corresponding array of switches, wherein the improvement comprises:

a sheet having a first side and an opposing second side with a plurality of apertures extending from the first to the second side, such apertures each extending, from and in registry with a keyface on the first side, to the corresponding switch at the second side;

a plurality of closed cells, each cell being disposed in one of the apertures and having first and second elastically deformable surfaces defining first and second ends thereof proximate to the first and second sides of the sheet, respectively;

each such cell being filled with a deformable medium at least somewhat resistant to compression for tranducing deformations of the first surface caused by pressure on the keyface, into deformations of the second surface for operating the corresponding switch;

each aperture being of a dimension to laterally confine the sidewalls of the cell disposed therein so that motion of the first surface is transduced into motion substantially only of the second surface without motion of the cell sidewalls.

2. The device of claim 1 wherein the medium includes a fluid.

3. The device of claim 1 wherein the medium is a rubber-like material and the first and second surfaces are the surfaces of the medium.

4. The device of claim 3 wherein the medium is an elastic foam material and the first and second surfaces include a self-skin integrally formed with the foam.

5. The device of claim 1 wherein the apertures have a different cross-sectional area at the first side, from the area at the second side of the sheet, so as to provide a desired feel of the first surface while transducing sufficient motion of the second surface to operate the corresponding switch.

6. The device of claim 1 wherein the apertures are of an hourglass shape.

7. The device of claim 6 wherein the hourglass shape is asymmetrical so as to vary the volume of the medium displaced by movement of the first surface and thereby provide a desired feel thereof while transducing sufficient motion of the second surface to operate the corresponding switch.

8. The device of claim 2 wherein the switches are attached to a second sheet.

9. The device of claim 8 wherein the fluid is glycerine.

10. The device of claim 8 wherein the fluid is air.

11. The device of claim 2 wherein the first surfaces are keyfaces having symbols formed thereon.

12. The device of claim 2 wherein the second surfaces have conductive material thereon, such material forming part of the corresponding switch of the corresponding cell.

13. The device of claim 3 wherein the first surfaces are keyfaces having symbols formed thereon.

14. The device of claim 3 wherein the second surfaces have conductive material thereon, such material forming part of the mating switch of the corresponding cell.

15. The device of claim 14 further including an outer covering means totally enclosing the device.

16. The device of claim 14, further including means for generating electrical energy from light for powering the device.

* * * * *